United States Patent [19]

Eckstein et al.

[11] 4,438,966

[45] Mar. 27, 1984

[54] LOCK FOR CARRYING CASES OF RESPIRATORS

[75] Inventors: William Eckstein, Sereetz; Gerd Pantaleon-Stemberg, Mölln, both of Fed. Rep. of Germany

[73] Assignee: Drägerwerk Aktiengesellschaft, Fed. Rep. of Germany

[21] Appl. No.: 292,493

[22] Filed: Aug. 13, 1981

[30] Foreign Application Priority Data

Feb. 9, 1980 [DE] Fed. Rep. of Germany ..... 3032915

[51] Int. Cl.[3] ..... E05C 19/18; B65D 45/16

[52] U.S. Cl. ..... 292/259 R; 292/307 R; 220/214; 220/324

[58] Field of Search ..... 292/259, 307 R, 207, 292/307 A, 307 B, 316, 322, 325; 220/324, 214

[56] References Cited

U.S. PATENT DOCUMENTS

| | | | |
|---|---|---|---|
| 785,574 | 3/1905 | Russell | 292/307 R |
| 1,260,299 | 3/1918 | Banes | 292/259 X |
| 1,516,609 | 11/1924 | Knoth | 292/307 R X |
| 3,107,935 | 10/1963 | Erke | 292/325 |
| 4,175,782 | 11/1979 | de Lima Castro Neto | 292/307 R |

FOREIGN PATENT DOCUMENTS

| | | | |
|---|---|---|---|
| 654819 | 10/1964 | Belgium | 220/324 |
| 2424045 | 2/1975 | Fed. Rep. of Germany | 220/214 |
| 1205782 | 2/1960 | France | 220/324 |

*Primary Examiner*—Gary L. Smith
*Assistant Examiner*—R. Illich
*Attorney, Agent, or Firm*—McGlew and Tuttle

[57] ABSTRACT

A lock is disclosed for a carrying case of an emergency respirator which case includes a bottom container part and a cover member held to the container part. At least one strap member is connected to the container part and the cover member to hold them together. The strap includes two strap ends which are held together by a toggle clamp which includes a holding member connected to one strap end which pivotally carries a lever, and a hook end of the other strap end which is engaged with the lever. A sealing piece having a recess is provided which slides over an end of the lever to hold the lever in a closed position. The hook end of the strap includes an opening which receives a protrusion extending from a portion of the sealing piece.

12 Claims, 2 Drawing Figures

LOCK FOR CARRYING CASES OF RESPIRATORS

FIELD AND BACKGROUND OF THE INVENTION

The present invention relates in general to respirators and in particular, to a new and useful lock for the carrying case of an emergency respirator.

Emergency respirators which are for the protection of a wearer, usually contain filter materials that are highly sensitive to moisture. Such respirators are therefore stored, during their usually long carrying time or shelf life, in tightly closing carrying cases. The parts of these cases, which are usually made up of a pot shaped part with a cover, are held together with locks by which they are braced against each other. These locks must be easy to open when needed, but until then, they should guarantee the air and moisture tightness of the carrying case. They must therefore be sealable. A person in charge of a group carrying such cases, can evaluate the functioning of the seals and make sure the seals remain intact.

The carrying cases carry various data on the outside, like manufacturer's mark, name and number of apparatus, delivery date, weight etc. These data were heretofore applied by stamping, punching or engraving.

A known strap lock for gas-tight cases for respirators keeps the two parts of the case, which are sealed from each other by packing between them, together by a circumferential metal strap with which the packing is covered at the same time. The metal strap is connected at one end with one or both parts of the case. To this end the strap is hook-shaped and extends behind corresponding fastening means of the case. The other end of the strap is provided with a tear-open lug for gripping, and is arranged above the first strap end. The two strap ends are held together by a clamp-like part whose yoke is under the metal strap bearing on the case, with a bent-off lug protruding through slot-type openings of the strap ends and holding them together. Outer clamp parts are in addition bent around the two strap ends. When the case is opened, these two clamp parts bend open and the upper clamp end with the tear off lug detaches itself from the bent-off lug. The metal strap can then be bent open further, and the cover of the case can be removed. A seal, which is secured above the outer strap end on the bent-off lug serves to secure the lock.

This known lock is difficult to close. It requires a special device, the seal can only be applied by an additional soldering operation. The necessary data can only be applied on the case itself (German utility model No. 17 34 071).

SUMMARY OF THE INVENTION

An object of the invention is to provide a seal for a lock on the carrying case of respirators, which is safe, simple to apply, and which permits application of the necessary data on the case itself.

The problem of the prior art is solved according to the invention in that the lock includes a sealing piece which has a recess for receiving an end of a locking lever which forms a part of a toggle clamp, the sealing piece having a portion with a protrusion extending therefrom which extends into an opening provided on a hook end of a strap which is used through the toggle clamp to hold the bottom container portion of the carrying case to a top cover portion thereof.

Another object of the invention is to provide a lock for the carrying case of a respirator having a container part and a cover member, with at least one strap having strap ends which are held together by a toggle clamp, the toggle clamp including a lever, the hook comprising the sealing piece having a recess slid over the lever, one strap end having a hook with an opening therein, and the sealing piece having a portion with a protrusion extending therefrom extending into the hook end opening.

Another object of the invention is to provide the sealing piece with a weakened area or break portion for permitting breakage of the sealing piece to release the toggle clamp.

A still further object of the invention is to provide such a lock wherein the toggle clamp includes a holding member for pivotally carrying the lever, the sealing piece having a portion extending over the holding member.

This advantageous solution of the problem provides a sealing piece which can be pushed over the closed toggle clamp without special tools or devices and be safely locked, and one which indicates clearly an undamaged seal. Inspectors of the respirators can open the carrying cases normally, inspect the apparatus, simply close the cases again, and seal the lock. The break makes tampering with the lock obvious at a very early stage and thus prevents such tampering. The larger outer surfaces of the flat portion and of the handle permit easy application of the necessary data. They can be simply updated after each check.

Making the sealing pieces in a signal color ensures an easy finding of the apparatus, which can be life-saving in an emergency situation.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
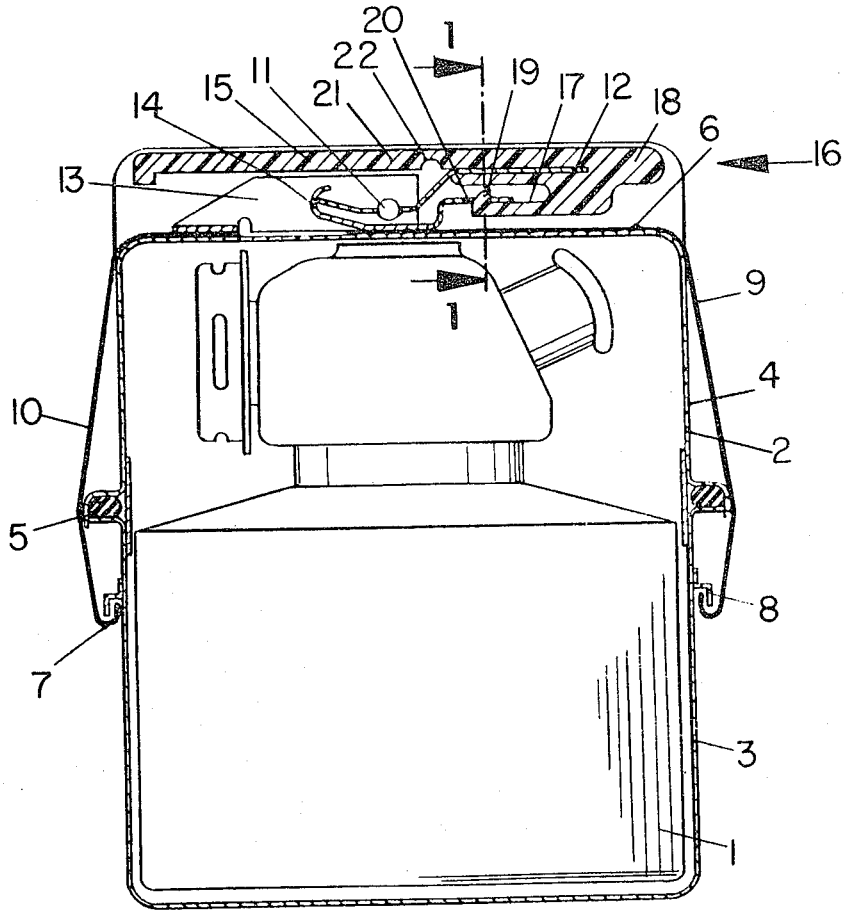
FIG. 1 is a side sectional view of a filled carrying case of the invention.
Figure 2:
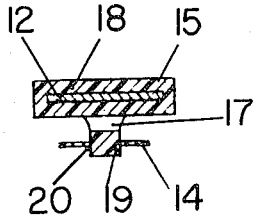
FIG. 2 is a view taken along line 1—1 of FIG. 1.

Turning to the drawings in particular, the invention embodied therein, in FIG. 1 comprises, a respirator 1 contained in a carrying case 2, which consists of a pot shaped part or container 3 and a cover member 4. The sealing between these two parts is effected by a packing 5. Pot 3 and cover 4 are tightly braced against each other by a tension strap 6. Strap 6 is suspended with hooks 7 in eyes 8 of pot 3.

Tension strap 6 itself consists of two parts, namely of a loop and hook 9 and a closing strap 10 which are pulled together over a toggle clamp 11 and held. Toggle clamp 11 comprises a lever 12 which is rotatably mounted in a mount or holding member 13, which is connected as a strap end of closing strap 10. For a closing toggle clamp 11, lever 12 extends over a hook 14 which is connected to an end of loop and hook 9. A sealing piece 15 is pushed, in direction 16, over lever 12 after lever 12 is pressed down into its closing position. Seal piece 15 has a recess matching the lever end. A hook part 17 below handle 18 of piece 15, has a molded-on protrussion 19, such as a saw-toothed tongue, which snaps into a fitting opening 20 of hook 14 after the insertion is completed.

Sealing piece 15 can be removed again only by destroying protrusion 19. But protrusion 19 also breaks off when toggle clamp 11 is to be opened. To this end, handle 18 of sealing piece 15 is bent upwardly. Flat portion 21, which is separated from handle 18 by a break 22, breaks off when the toggle clamp is opened. A complete sealing piece 15 guarantees an unopened carrying case 2.

Sealing piece 15 can be made in a signal color, e.g. red. The large outer surface of sealing piece 15 on handle 18 and flat portion 21 serves to receive the necessary data. Their application is simple on a sealing piece 15 made of injection-molded plastic.

While a specific embodiment of the invention has been shown and described in detail to illustrate the application of the principles of the invention, it will be understood that the invention may be embodied otherwise without departing from such principles.

What is claimed is:

1. A lock and seal combination for a carrying case of a respirator having a container part and a cover member, with at least one strap having strap ends held together by a toggle clamp to hold the container part to the cover member, the toggle clamp having a lever, comprising: a sealing piece (5) engaged to the cover member and having a recess for receiving the lever (12), one strap end having a hook portion (14) with an opening (20) in said hook portion; and the sealing piece having a portion with a protrusion (19) extending therefrom engaged into the hook portion opening; the toggle clamp including a holding member (13) connected to the other strap end for pivotally carrying the lever; one end of the lever engaged with the hook portion connected to the one strap end and another end of the lever engaged into the recess of the sealing piece.

2. A combination according to claim 1, wherein the hook portion includes a hook end engaged with the lever and an opposite end having the hook opening therein.

3. A combination according to claim 1, wherein the sealing piece has a flat portion extending over the holding member and a handle portion having the recess into which the lever extends.

4. A combination according to claim 3, wherein the portion of the sealing piece carrying the protrusion extends from beneath the handle.

5. A combination according to claim 1, wherein the protrusion comprises a saw-tooth shaped extension extending from the sealing piece portion.

6. A combination according to claim 4, including a break part between said flat portion and said handle portion of the sealing piece.

7. A combination according to claim 4, wherein the sealing piece includes a data receiving surface.

8. A combination according to claim 1, wherein the sealing piece is made of injection molded plastic.

9. A combination according to claim 1, wherein the sealing piece has a signal color.

10. In a carrying case for a respirator having a bottom pot part, a top cover part, a seal between the top and bottom parts, a pair of eye hooks connected to the bottom pot part, a first strap having one hook end engaged with one eye hook and an opposite hook end, a second strap having one hook end engaged with the other of said eye hooks and an opposite end, a holding member connected to said opposite end of said second strap, a lever pivotally mounted to said holding member having one end engaged with said opposite hook end of said first strap and an opposite lever end, the improvement comprising:

a sealing piece having a flat portion extending over said holding member and a handle portion having a recess therein;

said recess slidably receiving said opposite end of said lever with said lever in a closed position;

said sealing piece having a portion extending from said lever portion with a protrusion extending therefrom;

said opposite hook end of said first strap including a portion having an opening thereof for receiving said sealing piece protrusion.

11. The improvement of claim 10 wherein said sealing portion includes a weakened area between said flat portion and said handle portion.

12. The improvement of claim 11, wherein said sealing piece has a flat information receiving surface, is made of injection molded plastic and has a signal color.

* * * * *